US005384933A

United States Patent [19]

Wang

[11] Patent Number: 5,384,933

[45] Date of Patent: Jan. 31, 1995

[54] PANTS CLEANING AND STERILIZING APPARATUS

[76] Inventor: Ping-Shi Wang, No. 22, Lane 21, San-Chung Rd., Nan-Kang Dist., Taipei, Taiwan, Prov. of China

[21] Appl. No.: 237,933

[22] Filed: May 4, 1994

[51] Int. Cl.[6] ..... B08B 11/00; A46B 13/02

[52] U.S. Cl. ..... 15/311; 15/4; 15/40; 15/88.3

[58] Field of Search ..... 15/40, 34, 36, 77, 88.3, 15/310, 311, 4, 308, 303

[56] References Cited

U.S. PATENT DOCUMENTS 3,204,271 9/1965 Kingston ..... 15/40 X 4,233,707 11/1980 Leblanc ..... 15/34 X

*Primary Examiner*—Edward L. Roberts

*Attorney, Agent, or Firm*—Bacon & Thomas

[57] ABSTRACT

A pants cleaning and sterilizing apparatus, which includes a housing for receiving the user's leg, two rotary brushes turned in reversed directions by a motor drive to remove dust from the bottom of the pants upon the insertion of the user's foot, a sterilizing device for sterilizing the pants, a dust collecting drawer disposed inside the housing at the bottom for collecting dust, and an induced-draft fan for drawing away air from the housing to let dust be gathered in the dust collecting drawer.

3 Claims, 4 Drawing Sheets

PANTS CLEANING AND STERILIZING APPARATUS

FIELD OF THE INVENTION

The present invention relates to a pants cleaning and sterilizing apparatus which automatically removes dust from the pants and at the same time sterilizes the pants when the user put in the foot.

BACKGROUND OF THE INVENTION

While going outdoors, one's clothes (more particularly the legs of the pants) may be covered with dust soon. As soon as one enters the house, one may wipe off dust from the pants with a brush or the hand. However, when dust is removed from the pants, it will fly here and there to pollute the air and the house. Therefore, there is a strong desire of having a compact apparatus for removing dust from the pants without causing any pollution.

SUMMARY OF THE INVENTION

The present invent ion has been accomplished under the circumstances in view. It is one object of the present invention to provide a cleaning apparatus which can effectively remove dust from the pants. It is another object of the present invention to provide a cleaning apparatus which removes dust from the pants as the foot is put in. It is still another object of the present invention to provide a cleaning apparatus which sterilizes the pants when removing dust from the pants.

To achieve the aforesaid objects, there is provided a pants cleaning and sterilizing apparatus which comprises a housing for receiving the user's leg, two rotary brushes turned in reversed directions by a motor drive to remove dust from the bottom of the pants, a sterilizing device for sterilizing the pants, a dust collecting drawer disposed inside the housing at the bottom for collecting dust, and an induced-draft fan for drawing away air from the housing to let dust be gathered in the dust collecting drawer, a screen spaced above the dust collecting drawer to support the user's foot, and a push-button switch mounted on the screen and triggered to turn: on the sterilizing device, the motor drive and the induced-draft fan upon the insertion of the user's foot.

DETAILED DESCRIPTION OF THE PREFERRED EMBODIMENT

Figure 1:
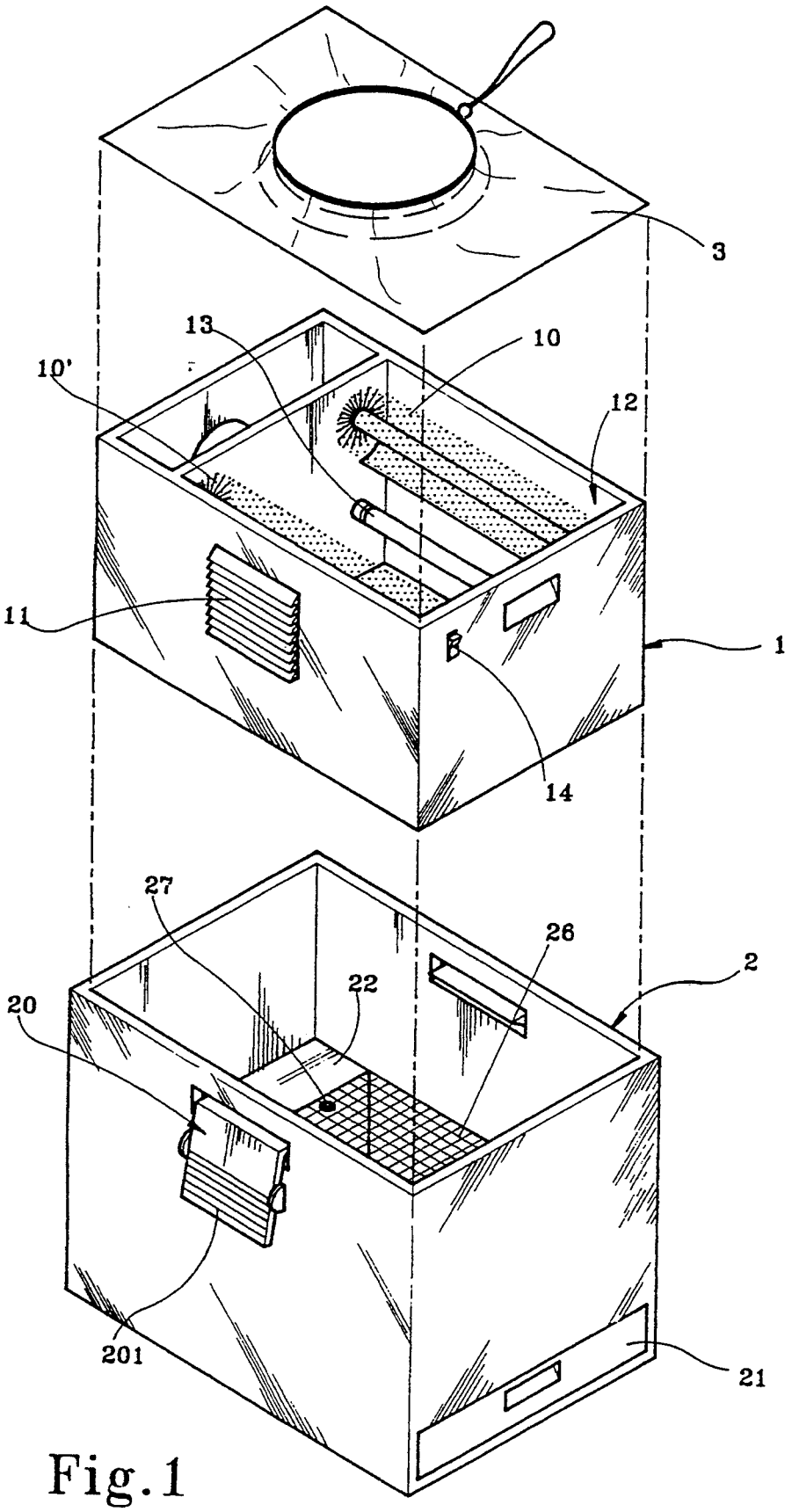
FIG. 1 is a perspective dismantled view of a paints cleaning and sterilizing apparatus according to the present invention.
Figure 2:
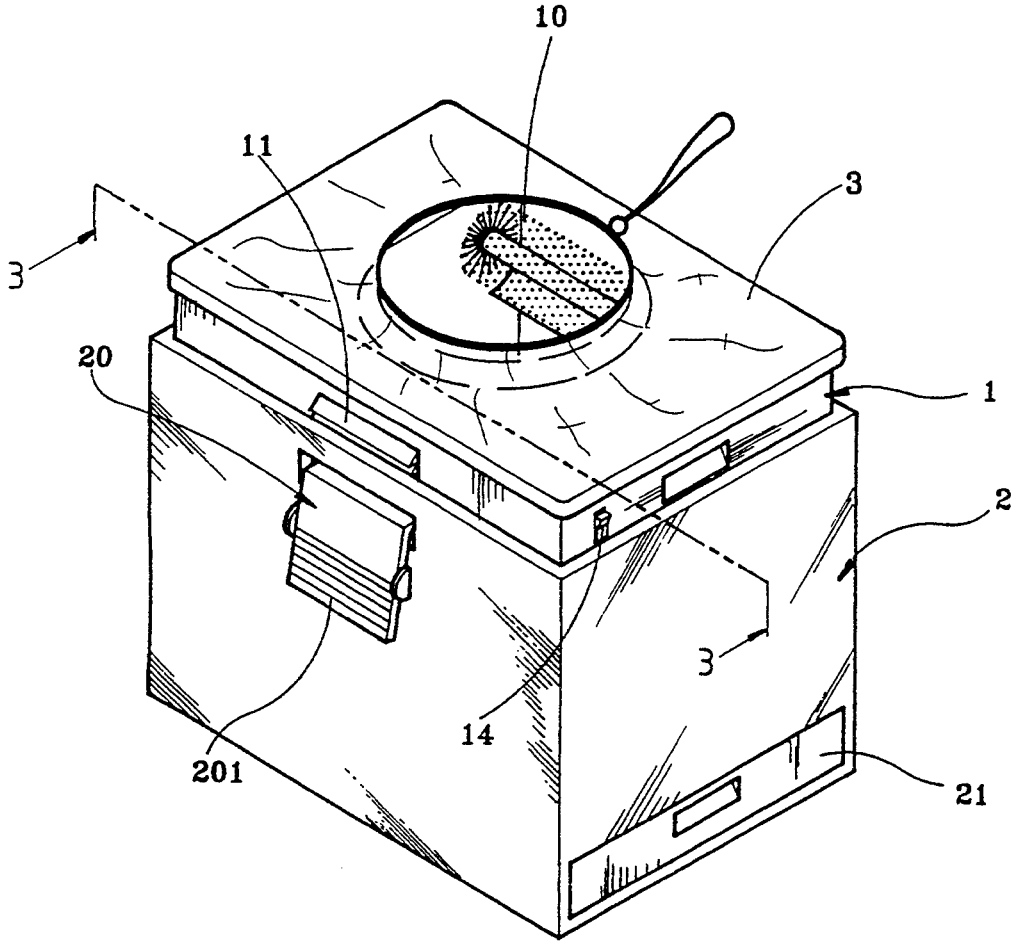
FIG. 2 is an elevational view of the paints cleaning and sterilizing apparatus shown in FIG. 1.
Figure 3:
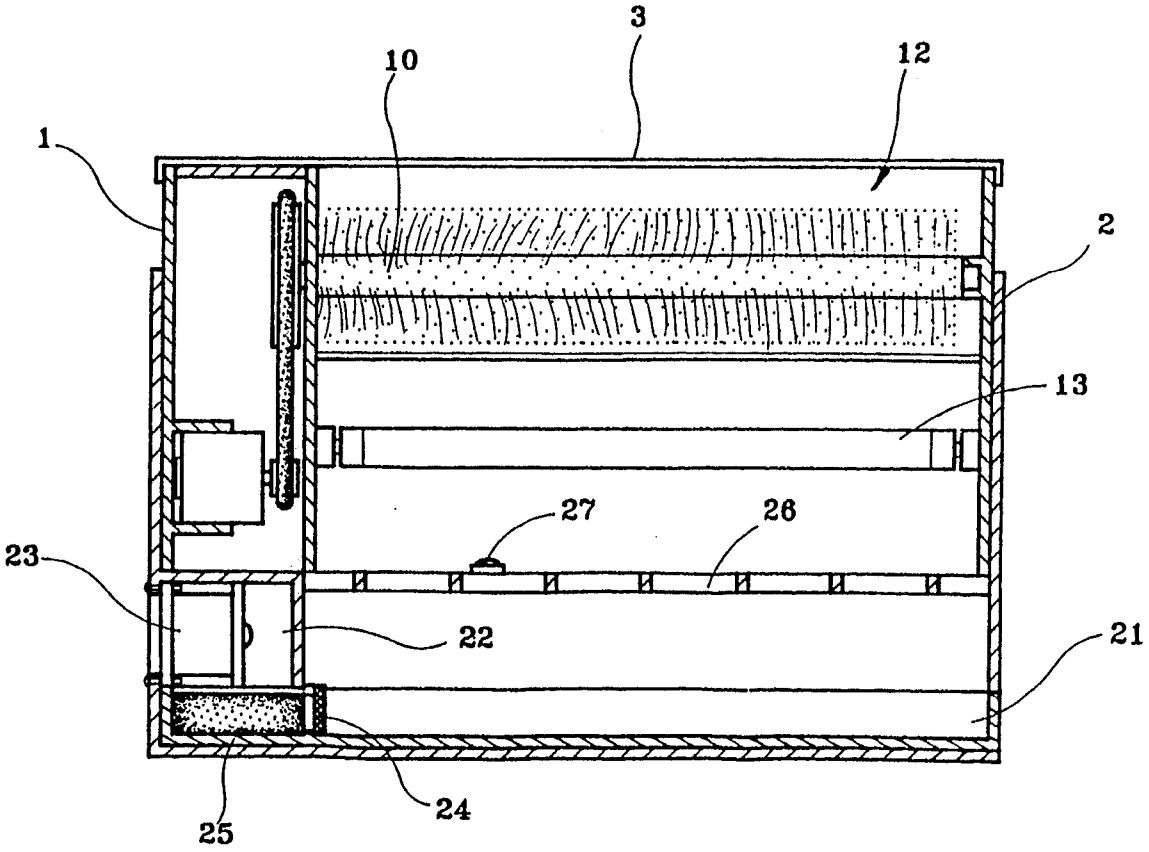
FIG. 3 is a front view in section of the paints cleaning and sterilizing apparatus shown in FIG. 1.

Referring to FIGS. 1, 2, and 3, a paints cleaning and sterilizing apparatus in accordance with the present invention comprises an upper casing 1 and a bottom casing 2. The upper casing 1 can he inserted, into the bottom casing 2 from the top and moved vertically within a limited range. Two motor-driven rotary brushes 10;10′ are bilaterally disposed inside the upper casing 1 near the open top thereof and turned to remove dust from the pants. The upper casing 1 comprises two ratchets 11 on two opposite sides thereof for positioning. The bottom casing 2 comprises two pawls 201 pivotally mounted in two opposite holes (not shown) on two opposite side walls thereof and engaged with the ratchets 11 on the upper casing 1. The pawls 201 allow the upper casing 1 to be lifted from the bottom casing 2 but they stop the upper casing 1 from moving downwards. By pressing the bottom ends 201 of the pawls 20, the pawls 21 are released from the ratchets permitting the upper casing 1 to be moved downwards within the bottom casing 2. Therefore, the elevation of the motor-driven rotary brushes 10;10′ can be conveniently adjusted.

The top opening 12 of the upper casing 1 is covered with a jacket 3, which can be fastened around the leg of the pants to prohibit dust from escaping out of the apparatus. The motor-driven rotary brushes 10;10′ are disposed in parallel and turned in reversed directions to remove dust from the leg of the pants. The space between the motor-driven rotary brushes 10;10′ must be sufficient for passing the leg. However, the space between the motor-driven rotary brushes 10;10′ must be limited so that the leg of the pants does not tangle while cleaning. Further, the brush wires of the motor-driven rotary brushes 10;10′ must be soft so that the motor-driven rotary brushes 10;10 do not hurt the user's leg when they are turned to remove dust from the paints.

There is a sterilizing device 13 installed inside the upper casing 1 below the motor -driven rotary brushes 10;10′. The sterilizing device 13 can be a ultraviolet lamp, ozonator, or chemical dispenser. The upper casing 1 further comprises a switch 14 for controlling the turning direction of the motor-driven rotary brushes 10;10′.

The bottom casing 2 comprises a dust collecting drawer 21 at the bottom for collecting dust removed by the motor-driven rotary brushes 10;10′, an air passage 22 disposed above the dust collecting drawer 21, an induced-draft fan 23 installed in the air passage 22 and operated to draw away air from the bottom casing 2 permitting dust be carried to the dust collecting drawer 21. A wire gauze filter 24 and a sponge 25 are respectively installed in the entrance of the air passage 22 to prohibit particles from being carried out of the bottom casing 2. A screen 26 is mounted inside the bottom casing 2 and spaced above the dust collecting drawer 21 to support the foot. A push-button switch 27 is mounted on the screen 26 for controlling the operation of the motor-driven rotary brushes 10;10′ the sterilizing device 13, and the induced-draft fan 23. Of course, the bottom of the upper casing must be opened so that the user's foot can be inserted through the upper casing 1 and stepped on the push-button switch 27.

Figure 4:
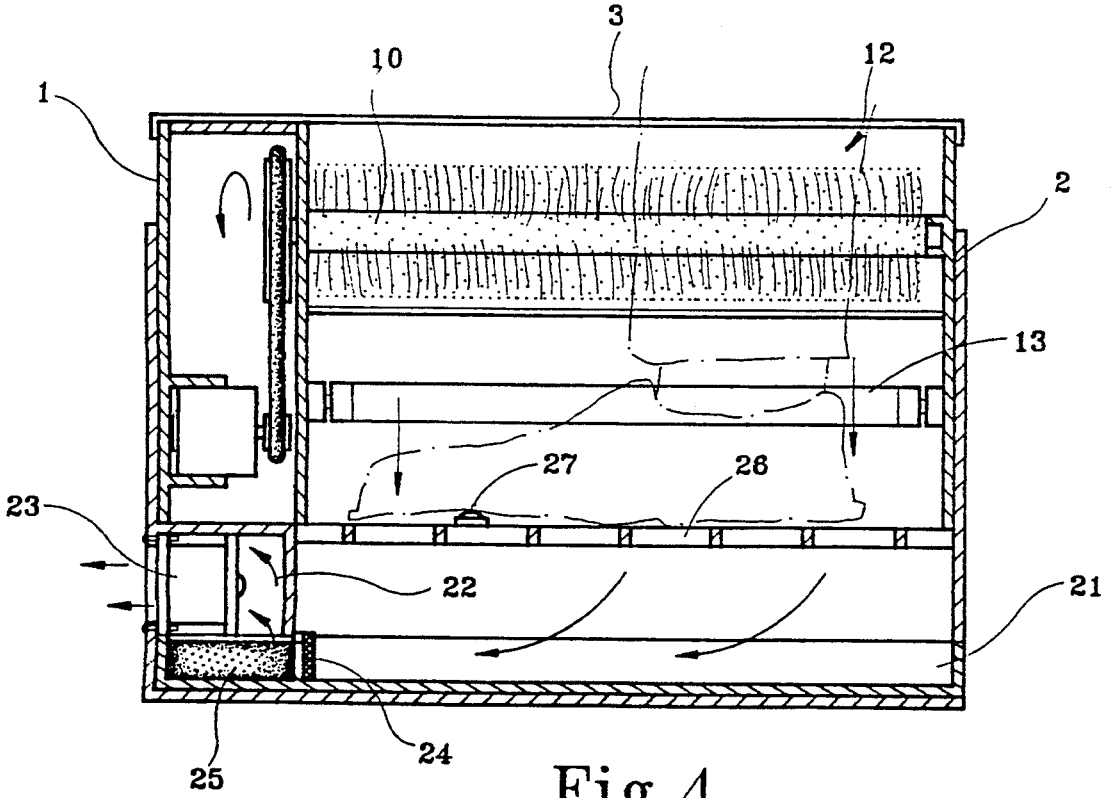
FIG. 4 is similar to FIG. 3 but showing the apparatus operated.

Referring to FIG. 4, When the user's leg is inserted through the gap between the rotary brushes 10;10′ and stepped on the push-button switch 27, the motor-driven rotary brushes 10;10′ are turned to remove dust from the pants, at the same time the sterilizing device 13is turned on to sterilize the pants.

Figure 5:
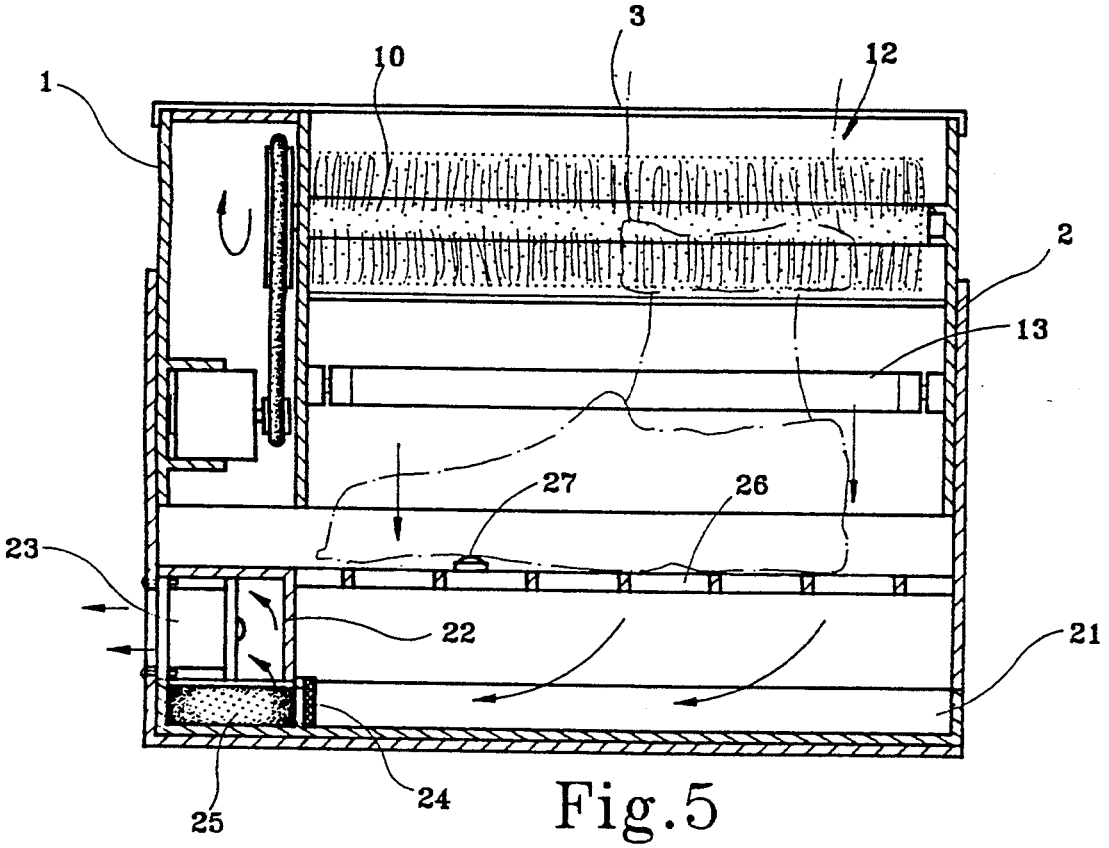
FIG. 5 is similar to FIG. 4 but showing the revolving direction of the rotary brushes respectively changed.

Referring to FIG. 5, when the bottom of the pants is folded up and turned inside out, the control switch 14 is switched to the reverse position causing the rotary brushes 10;10′ turned reversely to rub the pants from the bottom toward the top.

I claim:

1. A pants cleaning and sterilizing apparatus comprising:

a housing having an upper casing sliding vertically in a bottom casing thereof and fixed in position by a fastening device thereof, said upper casing having a jacket on a top opening thereof for covering around the leg being inserted and a bottom opening in communication with said bottom casing;

two rotary brushes disposed parallel inside said upper casing and turned reversed directions to remove dust from either leg of the pants inserted;

a reversible motor drive controlled to turn said rotary brushes in reversed directions;

a dust collecting device installed inside said bottom casing to gather and collect dust, said dust collecting device comprising a dust collecting drawer made to slide in and out of said bottom casing and an induced-draft fan controlled to draw away air from said bottom casing permitting dust to be collected in said dust collecting drawer, air filter means disposed between said induced-draft fan and said dust collecting drawer to prohibit dust from being carried out of said bottom casing;

screen disposed inside said bottom casing and spaced above said dust collecting drawer;

sterilizing device installed inside said bottom casing and controlled to sterilize the pants inserted;

a push-button power switch controlled to turn on said motor drive, said induced-draft fan, and said sterilizing device; and a control switch controlled to change the turning direction of said motor drive.

2. The pants cleaning and sterilizing apparatus of claim 1 wherein said sterilizing device is a ultraviolet lamp.

3. The pants cleaning and sterilizing apparatus of claim 1 wherein said sterilizing device is a ozonator.

* * * * *